US006234447B1

(12) United States Patent
Boyden et al.

(10) Patent No.: US 6,234,447 B1
(45) Date of Patent: May 22, 2001

(54) SPACER FOR CONCRETE FORM WALLS

(75) Inventors: John Allan Boyden; Dale Przybylowicz, both of Fenton, MI (US)

(73) Assignee: Allor Manufacturing, Inc., Brighton, MI (US)

( * ) Notice: Subject to any disclaimer, the term of this patent is extended or adjusted under 35 U.S.C. 154(b) by 0 days.

(21) Appl. No.: 09/224,422

(22) Filed: Dec. 31, 1998

(51) Int. Cl.[7] ..... F04G 11/06

(52) U.S. Cl. ..... 249/34; 249/4; 249/5; 249/216; 249/219.1; 254/13; 254/88; 269/204; 269/41

(58) Field of Search ..... 249/2, 190, 216, 249/219.1, 4, 5, 34; 269/143, 147, 249, 204, 41; 254/13, 88

(56) References Cited

U.S. PATENT DOCUMENTS

| | | | | |
|---|---|---|---|---|
| 1,490,284 | | 4/1924 | MacLeod . | |
| 1,956,771 | * | 6/1932 | McKeown | 249/216 |
| 1,970,946 | * | 8/1934 | Schenk | 249/34 |
| 2,140,669 | * | 12/1938 | Vigier | 25/131 |
| 2,973,792 | * | 3/1961 | Fonken | 144/303 |
| 3,697,039 | | 10/1972 | Phelps et al. . | |
| 3,843,084 | | 10/1974 | Gregory et al. . | |
| 5,016,855 | | 5/1991 | Huggins . | |
| 5,029,803 | | 7/1991 | Schworer . | |

* cited by examiner

*Primary Examiner*—Carl D. Friedman
*Assistant Examiner*—Christy M. Syres
(74) *Attorney, Agent, or Firm*—Young & Basile, P.C.

(57) ABSTRACT

A spacer for use in maintaining inner and outer concrete form walls at a specified uniform spacing. The spacer includes a screw shaft having a right hand threaded portion and a left hand threaded portion; a first nut threadably mounted on the left hand threaded portion; a second nut threadably mounted on the right hand threaded portion; a first spacer plate secured to and extending downwardly from the first nut; a second spacer plate secured to and extending downwardly from the second nut; and a stabilizer and stiffener assembly including a male guide structure secured to the first nut and including a rod extending generally parallel to the screw shaft and a female guide structure secured to the second nut and defining a socket telescopically receiving the free end of the rod. Turning movement of the shaft varies the axial spacing between the first and second spacer plates to establish and maintain a desired spacing between the inner and outer form walls while the telescopic receipt of the rod in the socket precludes relative rotation between the first and second nuts and further acts in coaction with the parallel shaft to stiffen the overall assembly so as to avoid buckling of the screw shaft as the spacer plates are moved outwardly to spread the form walls or inwardly to squeeze the form walls together.

7 Claims, 2 Drawing Sheets

SPACER FOR CONCRETE FORM WALLS

FIELD OF THE INVENTION

This invention relates to spacer devices and more particularly to a spacer device especially suitable for use in maintaining inner and outer concrete form walls at a specified uniform spacing.

BACKGROUND OF THE INVENTION

Foundation Contractors set up their forms with an inner form wall and an outer form wall and thereafter pour liquid concrete into the space between the walls to form the poured concrete foundation. As the concrete is poured and as the concrete hardens, the upper edges of the walls in particular tend to move out of alignment with each other. Specifically, they tend to squeeze in toward each other. As a result, if this condition is not corrected, the resulting poured concrete foundation will have a distorted, relatively thin upper edge portion.

In the past, various attempts have been made to prevent this inward squeezing movement of the upper edges of the form walls such, for example, as by putting wooden chocks between the upper edges of the walls or by the use of clamps engaging the upper edges of the walls. However, these and other prior art procedures are labor intensive and often ineffective.

SUMMARY OF THE INVENTION

This invention is directed to the provision of a spacer that is effective in maintaining the inner and outer form walls of a concrete foundation at a specified uniform spacing.

More particularly, this invention is directed to the provision of a concrete form wall spacer that is simple in construction and effective in operation.

The invention is operative to maintain inner and outer foundation form walls at a specified uniform spacing. The invention spacer includes a shaft; first and second spacer plates positioned in axially spaced relation along the shaft and adapted to engage faces of the respective inner and outer form walls; means operative to vary the axially spacing between the first and second spacer plates to thereby vary or maintain the spacing between the inner and outer form walls; and a stabilizer and stiffener assembly extending between axially spaced locations along the shaft and including a male guide structure including a rod extending generally parallel to the screw shaft and a female guide structure including guide means slideably receiving the rod. With this arrangement the spacer plates provide the desired spacing between the inner and outer form walls while the stabilizer and stiffener assembly acts in coaction with the parallel shaft to stiffen the overall assembly so as to avoid buckling of the shaft as the spacer plates are moved outwardly or inwardly to spread or contract the form walls.

According to a further feather of the invention, the shaft includes a first threaded portion and a second oppositely threaded portion; the operative means includes first and second nuts mounted on the first and second threaded portions; and the first and second spacer plates are secured to the first and second nuts. With this arrangement, the spacer plates may be moved toward and away from each other by a simple rotating movement of the shaft.

According to a further feature of the invention, the male guide structure is secured to one of the nuts and the female guide structure is secured to the other of the nuts, and the guide means comprises a socket telescopically receiving a free end of the rod. With this arrangement, the telescopic receipt of the rod in the socket as the spacer plates are moved toward and away from each other precludes relative rotation between the first and second nuts and stiffens the assembly to avoid buckling of the shaft.

In the disclosed embodiment of the invention, the spacer further includes a handle secured to one end of the screw shaft to facilitate turning of the screw shaft. This handle structure allows the screw shaft to be readily turned to selectively move the spacer plates toward and away from each other.

DETAILED DESCRIPTION OF THE PREFERRED EMBODIMENT

Figures 1, 3:
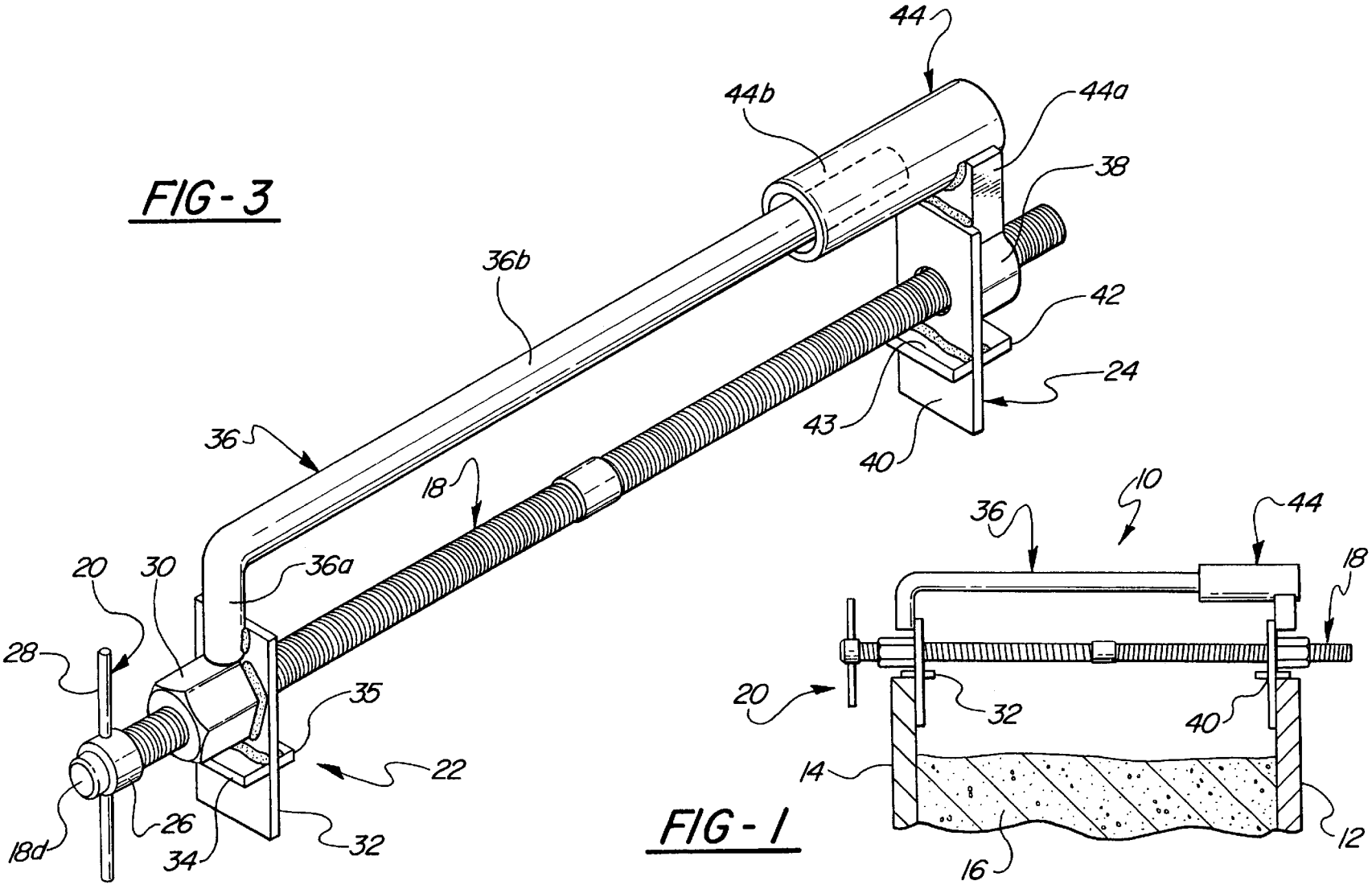
FIG. 1 is a cross-sectional, somewhat schematic view showing the general operation of the invention spacer.
FIG. 3 is a perspective view the spacer.
Figure 2:
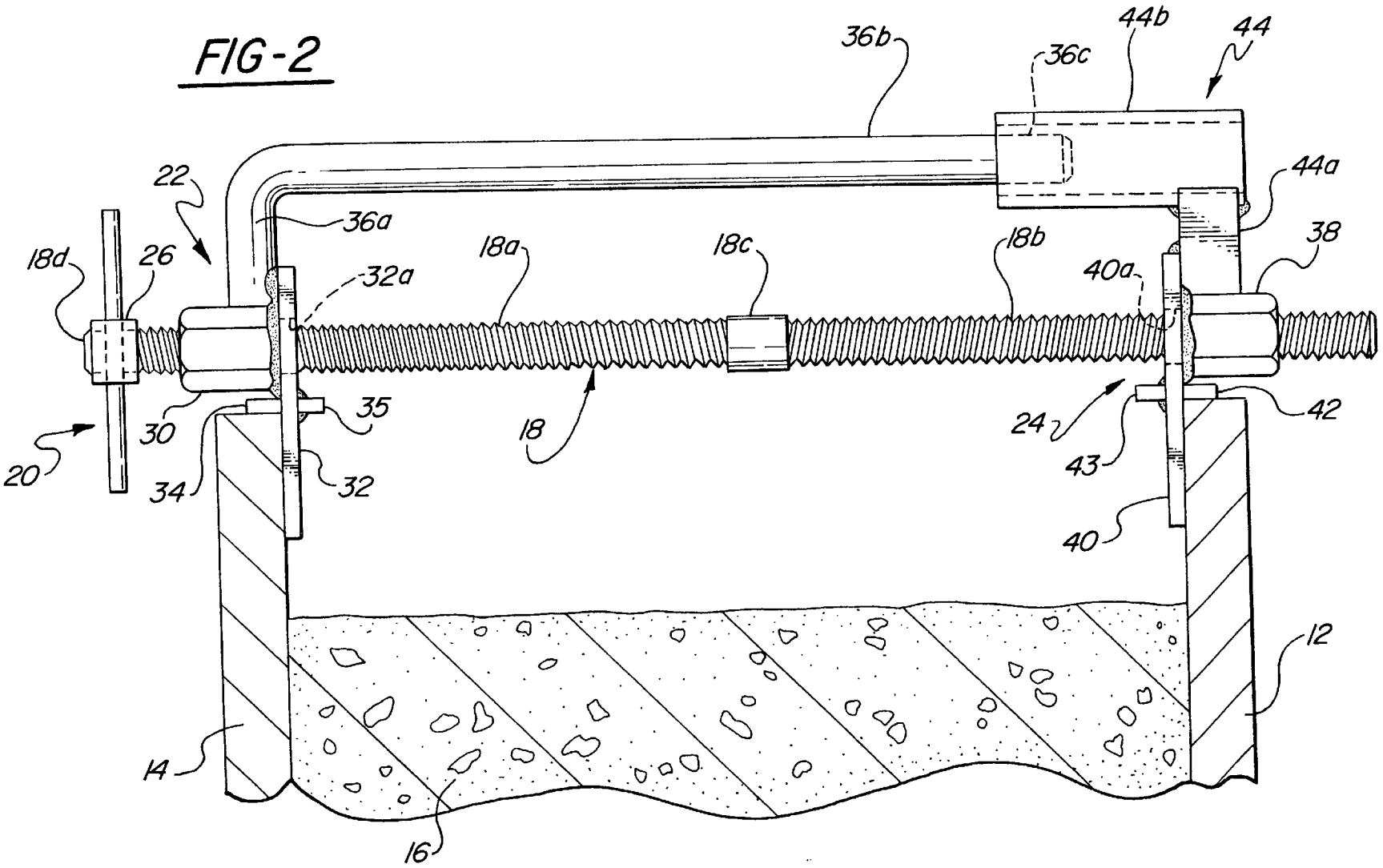
FIG. 2 is a detail, side-elevational view of the spacer.

The invention spacer 10 as seen in FIG. 1 is intended to maintain inner and outer concrete form walls 12 and 14 at a specified uniform spacing so that a poured concrete wall formed by pouring concrete 16 into the space between the inner and outer form walls has a uniform thickness throughout its height.

Spacer 10, broadly considered, includes a screw shaft 18, a handle assembly 20, a left weldment 22, and a right weldment 24.

Screw shaft 18 comprises a modified acme screw and includes a portion 18*a* having a right hand thread, a portion 18*b* having a left hand thread, and a smooth shank portion 18*c* intermediate the threaded portions 18*a* and 18*b*.

Handle assembly 20 includes an annular thread cover 26 positioned in surrounding relation to the left hand end 18*d* of the screw shaft and a handle bar 28 passing through diametrically opposed apertures in the cover 26 and through a central diametric through bore 18*e* in the end 18*d* of the shaft.

Left weldment 22 includes a threaded collar or nut 30 threadably mounted on the right hand thread portion 18*a* of the shaft and having compatible threading; a spacer or spreader plate 32 welded to the inboard face of nut 30, having an aperture 32*a* passing right hand thread portion 18*a*, and extending downwardly from the nut 30 for engagement with an inboard face of outer form wall 14; a stop plate or rest plate 34 welded to spacer plate 32 and extending horizontally outboard from spacer plate 32 immediately beneath nut 30; a stop or rest plate 35 welded to spacer plate 32 in horizontal alignment with plate 34 and extending horizontally inboard from spacer plate 32; and a male guide structure including a stiffener rod 36 having a post portion 36*a* welded to and upstanding from nut 30 and a stabilizer portion 36*b* extending generally parallel to screw shaft 18 and defining a free end 36*c*.

Right weldment 24 comprises a threaded collar or nut 38 threadably mounted on the left hand thread portion 18*b* of the screw shaft and having compatible threading; a spacer or spreader plate 40 welded to the inboard face of nut 38, having an aperture 40*a* passing screw shaft portion 18*b*, and extending downwardly from the nut for engagement with an inboard face of inner form wall 12; a stop or rest plate 42 welded to the outboard face of spacer plate 40 and extending horizontally outboard from the spacer plate immediately beneath nut 38; a stop or rest plate 43 welded to spacer plate

40 in horizontal alignment with plate 42 and extending inboard from the spacer plate 24; and a female guide structure 44 including a post portion 44*a* upstanding from nut 38 and a socket portion 44*b* extending generally parallel to the axis of screw shaft 18 and telescopically receiving the free end 36*c* of stabilizer rod portion 36*b*.

OPERATION

When used to spread the form walls, after the inner and outer form walls have been established and the concrete poured, handle bar 28 is turned to move the spacer plates 32, 40 to a position where they are separated by an axial distance less than the distance between the inner and outer form walls, whereafter the spacer is positioned between the form walls with the stop or rest plates 34, 42 positioned on the upper edges of the inner and outer form walls and the spacer plates positioned proximate the inboard faces of the inner and outer form walls, whereafter the handle is turned in a sense to move the left and right weldments apart and move the inner and outer walls back to their specification spacing. The telescopic receipt of rod end 36*c* in socket 44*b* precludes relative rotation between the left and right weldments and further acts in coaction with the parallel screw shaft to stiffen the overall assembly so as to avoid buckling of the screw shaft as the spacer plates are moved outwardly to spread the form walls.

It will be understood that, when used to squeeze the form walls together, the spacer plates are positioned proximate the outboard faces of the inner and outer form walls, the stop or rest plates 35, 43 are positioned on the upper edges of the inner and outer form walls, and the handle is turned to move the spacer plates together and squeeze the form walls back to their specification spacing.

The invention will be seen to provide a spacer that is especially suitable for use with concrete form walls. More specifically, the invention will be seen to provide a concrete form wall spacer that is simple and inexpensive in construction, easy to operate, and effective to readily establish and maintain a desired spacing between inner and outer form walls.

Whereas a preferred embodiment of the invention has been illustrated and described in detail, it will be apparent that various changes may be made in the disclosed embodiment without departing from the scope or spirit of the invention.

We claim:

1. A spacer for maintaining inner and outer concrete form walls at a specified uniform spacing, the spacer including:

a shaft including a first threaded portion and a second oppositely threaded portion;

first and second spacer plates positioned in axially spaced relation along the shaft and adapted to engage inboard faces of the respective inner and outer form walls;

first and second nuts threadably mounted on the first and second threaded portions respectively and fixedly secured to the first and second spacer plates respectively; and a stabilizer and stiffener assembly extending between axially spaced locations along the shaft and including a male guide structure secured to the first nut and including a rod extending generally parallel to the screw shaft and a female guide structure secured to the second nut and including guide means slidably receiving the rod.

2. A spacer according to claim 1 wherein the male guide structure is secured to one of said nuts and the female guide structure is secured to the other of said nuts; and the guide means comprises a socket telescopically receiving a free end of the rod.

3. A spacer for maintaining inner and outer concrete form walls at a specified uniform spacing, the spacer including;

a screw shaft having a threaded portion;

a nut threadably mounted on the shaft threaded portion;

a collar structure mounted on the shaft in axially spaced relation to the nut;

a first spacer plate secured to and extending downwardly from the nut;

a second spacer plate secured to and extending downwardly from the collar structure; and a stabilizer and stiffener assembly including a male guide structure fixedly secured to one of said nut and collar structure and including a rod extending generally parallel to the screw shaft, and a female guide structure fixedly secured to the other of said nut and collar structure and including means slideably receiving the rod.

4. A spacer according to claim 3 wherein;

the shaft threaded portion comprises a first shaft threaded portion;

the shaft further includes a second threaded portion oppositely handed with respect to the first threaded portion;

the nut comprises a first nut; and the collar structure comprises a second nut mounted on the second threaded portion.

5. A spacer according to claim 4 wherein the male guide structure is secured to one of said nuts and the female guide structure is secured to the other of said nuts; and the slideably receiving means comprises a socket telescopically receiving a free end of the rod.

6. A spacer for maintaining inner and outer concrete form walls at a specified uniform spacing, the spacer including;

a screw shaft having a right hand threaded portion and a left hand threaded portion;

a first nut threadably mounted on the left hand threaded portion;

a second nut threadably mounted on the right hand threaded portion;

a first spacer plate fixedly secured to and extending downwardly from the first nut for positioning against a face of the inner form wall;

a second spacer plate fixedly secured to and extending downwardly from the second nut for positioning against a face of the outer form wall;

a stabilizer and stiffener assembly including a male guide structure secured to the first nut and including a rod extending generally parallel to the screw shaft and a female guide structure secured to the second nut and defining a socket telescopically receiving a free end of the rod.

7. A spacer according to claim 6 wherein the spacer further includes a handle secured to one end of the screw shaft to facilitate turning of the screw shaft.

* * * * *